US006189756B1

(12) United States Patent
Ward

(10) Patent No.: US 6,189,756 B1
(45) Date of Patent: Feb. 20, 2001

(54) HOLSTER ATTACHMENT DEVICE

(75) Inventor: Robert Cleveland Ward, Nevada, MO (US)

(73) Assignee: Mil-Tech, Inc., Nev., MO (US)

( * ) Notice: Under 35 U.S.C. 154(b), the term of this patent shall be extended for 0 days.

(21) Appl. No.: 09/212,177

(22) Filed: Dec. 15, 1998

(51) Int. Cl.[7] ..... A45L 15/00

(52) U.S. Cl. ..... 224/575; 224/240; 224/671; 224/622; 224/674; 224/911; 224/912

(58) Field of Search ..... 224/575, 242, 224/238, 240, 198, 271, 272, 243, 192, 232, 234, 911, 912, 904, 674, 671, 672; 2/311, 321, 322, 336, 243.1, 275

(56) References Cited

U.S. PATENT DOCUMENTS

| | | | | |
|---|---|---|---|---|
| 865,222 | * | 9/1907 | Woodward | 224/674 X |
| 1,416,153 | * | 5/1922 | Wright | 224/674 X |
| 4,667,374 | * | 5/1987 | Bianchi | 24/3.9 |
| 4,886,197 | * | 12/1989 | Bowles et al. | 224/243 |
| 5,236,113 | * | 8/1993 | Wisser | 224/243 |
| 5,294,028 | * | 3/1994 | Bankroff | 224/674 X |
| 5,632,426 | * | 5/1997 | Beletsky et al. | 224/243 |

* cited by examiner

*Primary Examiner*—Gregory M. Vidovich
*Assistant Examiner*—Maerewa W. Brevard
(74) *Attorney, Agent, or Firm*—Chase & Yakimo, L.C.

(57) ABSTRACT

A one-piece belt loop device of a relatively rigid material for use with a web of Velcro® fastener material includes a base having top and bottom edges with a pair of side edges extending therebetween. Recesses in the top and bottom edges provide guidelines for stitching the top and bottom edges of the base to the holster with the side edges free of the holster. The base thus presents a first loop for extension of a user's belt therethrough. A central housing presents upper and lower apertures with a raised central surface therebetween for attachment of a spring belt clipped thereto to clip the holster to the user's belt. A thumb break strap can be further extended between the apertures and has Velcro® material thereon releasably engageable with the underlying Velcro® material. The belt loop device enhances assembly and presents a reinforced belt attachment structure.

25 Claims, 3 Drawing Sheets

HOLSTER ATTACHMENT DEVICE

BACKGROUND OF THE INVENTION

This invention relates to a holster and, more particularly, to an improved holster loop and method of affixing the same to a nylon holster.

The introduction of nylon holsters into the industry has provided many advantages over the leather holster including economy in manufacture. Also, the holster may be attached to the belt of the user by providing a belt loop on the holster for the user's belt. Alternatively, a belt spring clip can be attached to the holster which is clipped to the user's belt.

Heretofore, the placement of the belt loop on a nylon holster was a labor-intensive process. The loop included a first web piece, a Velcro® fastener material and a second piece of web material. The materials were sewn together to the side of a nylon holster to provide a loop for the user's belt and a second loop for vertical extension of a thumb break strap therethrough. This second loop also provided a purchase surface for attachment of the spring belt clip thereto. The sewing of these materials onto the nylon holster resulted in a labor-intensive process.

In response thereto I have invented a single, one-piece loop device which is easily sewn to the holster with a Velcro® fastener material therebetween. The device presents a first belt loop for extension of the user's belt therethrough and a second overlying loop for extension of the thumb break strap therethrough. The loop device presents guides for stitching which enables the assembler to sew the loop device to a side of a nylon holster with the Velcro® material therebetween in a one-step process. Thus, the labor costs are reduced and a reinforced belt loop is presented. The loop device thus presents a first loop for extension of the user's belt therethrough and a second loop for extension of a thumb break strap therethrough as well as a purchase surface for a spring belt clip.

It is therefore an object of this invention to provide an improved belt loop device for attachment to a holster which presents first and second loops for a user's belt, thumb break strap and spring belt clip.

Another object of this invention is to provide an improved belt loop device, as aforesaid, which is relatively rigid in construction as compared to the holster material.

A further object of this invention is to provide a belt loop, as aforesaid, which presents guides for stitching the belt loop device and underlying Velcro® fastener element to the side of a holster.

A still further object of this invention is to provide a belt loop, as aforesaid, which reduces the labor and material costs of assembly.

Another particular object of this invention is to provide a belt loop device, as aforesaid, which provides a reinforced purchase surface for attachment of a spring belt clip thereto.

Other objects and advantages of this invention will become apparent from the following description taken in connection with the accompanying drawings, wherein is set forth by way of illustration and example, a now preferred embodiment of this invention.

DESCRIPTION OF THE PREFERRED EMBODIMENT

Figure 1:
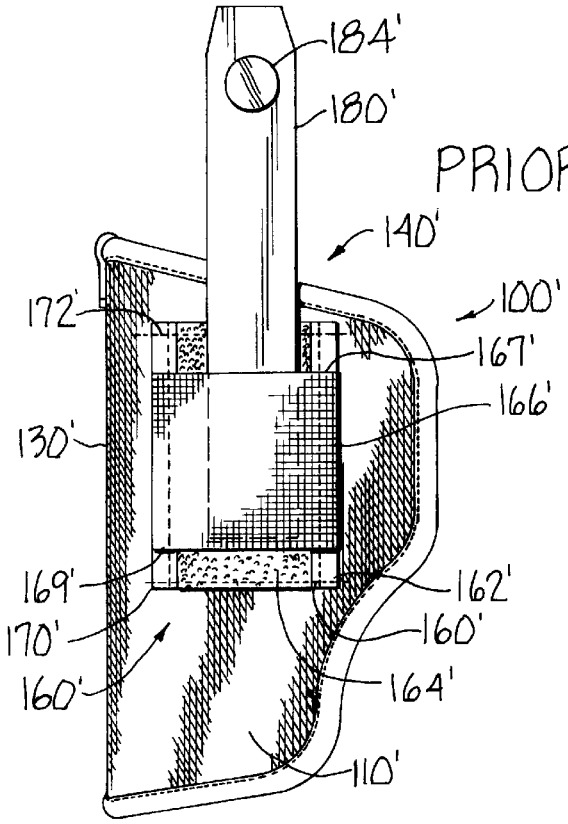
FIG. 1 is a side elevation view of a holster showing a prior art belt loop assembly in place with a rigid thumb break strap vertically extending therefrom.
Figure 2:
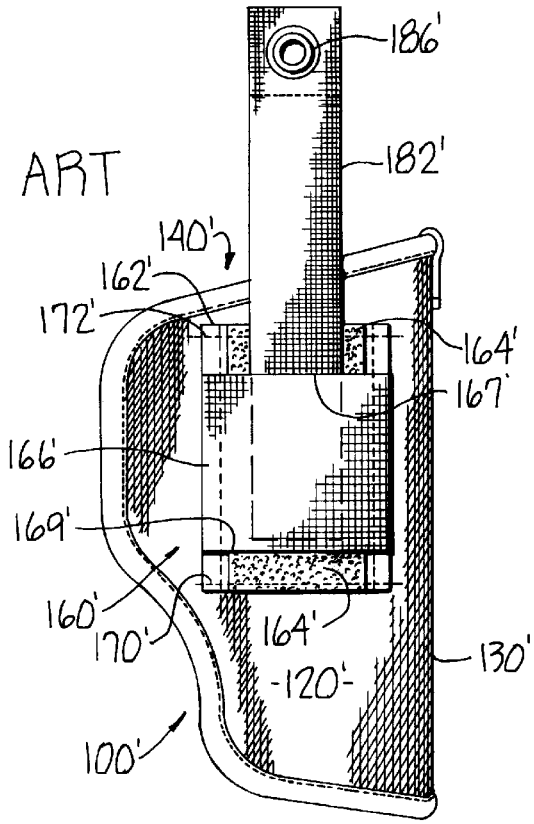
FIG. 2 is an opposed side elevation view of the FIG. 1 holster showing an opposed belt loop assembly in place with a flexible thumb break strap in place.

Turning more particularly to the drawings, FIG. 1 shows a prior art nylon holster 100' having first 110' and second 120' sides and a front spine 130'. The holster 100' presents an opening 140' for insertion of a gun therein.

On each side of the holster 100' is a belt loop assembly 160'. The belt loop assembly includes a first piece of flexible web material 162' having a Velcro® loop-type material 164' sewn thereon. A second piece of flexible web material 166', sewn at its side edges only to the web material 162', traverses the Velcro® material 162'. This entire assembly 160' is then attached to the side of the holster 110' by stitch lines 170', 172' along the top and bottom edges of the web 162'.

As such, the first web 162' presents a first loop for extension of the user's belt therethrough. The second web 166' presents a second loop for insertion of a thumb break strap 180' therein. The thumb break strap has mating Velcro® material on one side thereof for releasable engagement with the Velcro® material 164'. Thus, the extension of the thumb break strap 180' above the opening 140' of the holster 100' can be adjusted. A similar loop assembly 160' is found on the opposed side 120' of the holster 100'. In the opposed loop assembly the thumb break strap 182' is more flexible relative to the more rigid strap 180'. Upon insertion of the gun into the holster the tops of the thumb break straps 180', 182' are joined at the fasteners 184', 186' so as to extend atop the holstered gun and maintain the gun within the holster 100'.

Figure 9:
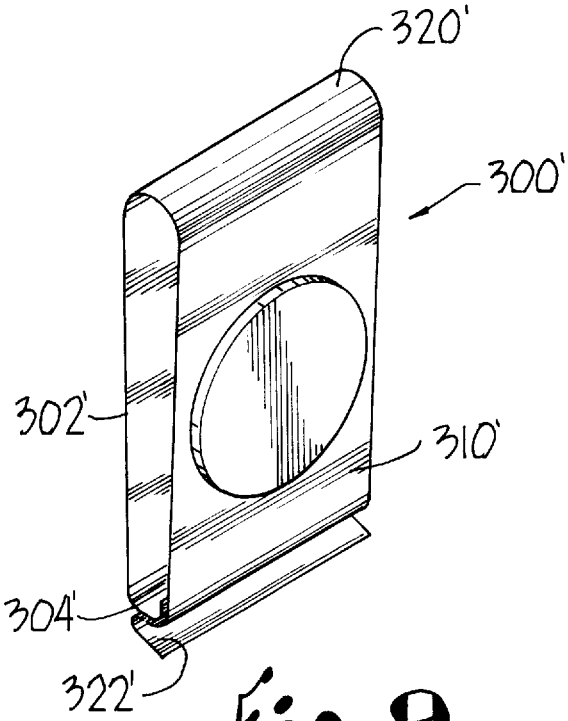
FIG. 9 is a perspective view of a spring belt clip.

The second web 166' also provides a surface for attachment of the spring clip 300 as shown in FIG. 9. The spring clip 300' includes a back flange 302' with a U-shaped portion 304' at the bottom thereof. The spring clip 300' further includes a front flange 310'. A curved top edge 320' joins the front 310' and rear 302' flanges. An S-shaped free end 320' is at the bottom of front flange 310'. Upon insertion of the back flange 302' behind the web 166' the top 320' of the spring belt clip will bear against the top edge 167' of the web 166' with the bottom edge 169' of the second web 166' extending into the U-shaped portion 304'. Accordingly, upon displacement of the first flange 310' from the web material 166', the user's belt is inserted between the web 166' and the front flange 310'. The resiliency of the spring clip will cause the first flange 310' to return to its original position so as to clip the holster to the user's belt.

As above described, it can be seen that the manufacture and attachment of the loop assembly 160' is a labor intensive one as three pieces of material 162', 164', 166' must be secured together and affixed to a side of the holster. Also, the support offered by the traverse web 166' to the belt clip 300' may not be sufficient particularly if a heavy gun is in the holster.

Figure 3:
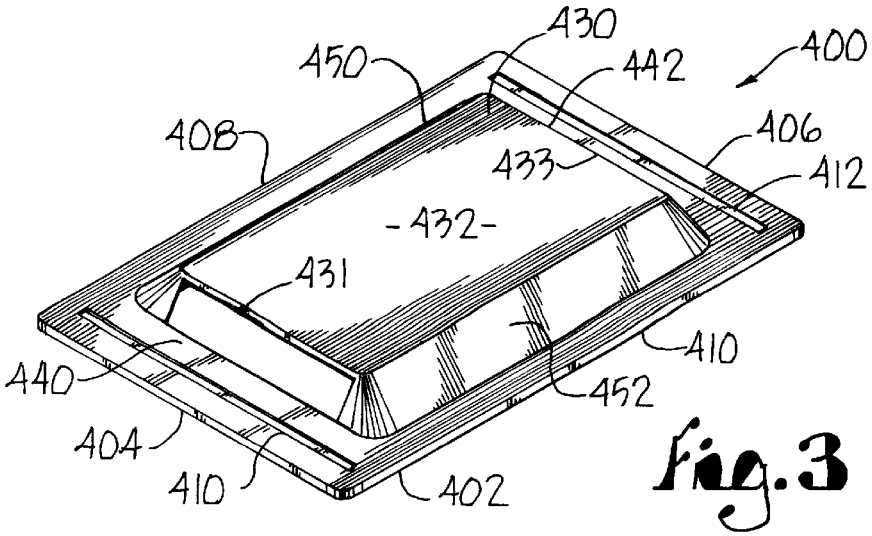
FIG. 3 is a perspective view of the improved one-piece loop device as removed from the holster.

In response to the above-discussed prior art, I have invented a one-piece loop device 400 as shown in FIG. 3. The device 400 generally comprises a rectangular base 402 having a bottom edge 404 and a top edge 406 with a pair of side edges 408, 410 extending therebetween. The device 400 is preferably made of a material relatively more rigid than the nylon material of the holster 100'. Parallel to the top 406 and bottom 404 edges of base 402 are recesses 410, 412 which provide guides for stitching 414, 416 thereon for attaching the loop device to the holster.

Within the confines of the base 402 is a raised central housing 430 presenting a planar surface 432 generally parallel to the underlying base 402. The central housing 430 further presents lower 440 and upper 442 apertures extending between the top 433 and bottom 431 edges of the central surface 432 and underlying base 402. Side walls 450, 452 further extend between the base 402 and central surface 432.

Figure 4:
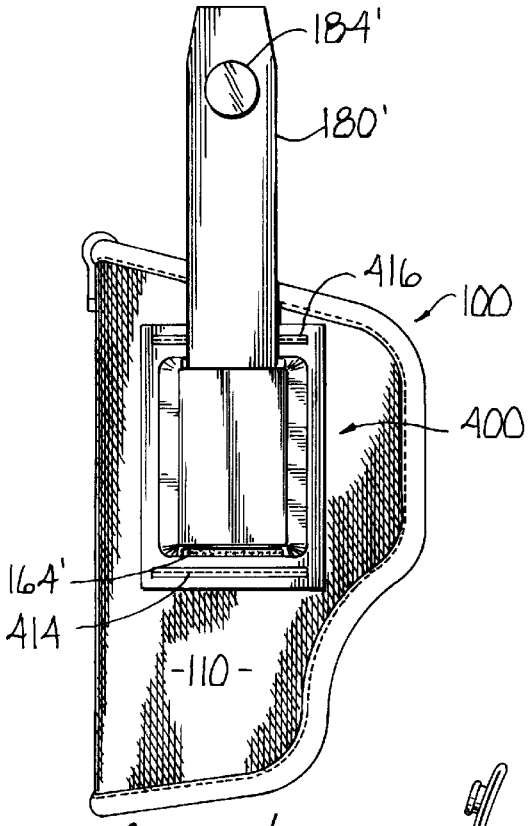
FIG. 4 is an elevation view showing the improved device of FIG. 3 in place on one side of a holster with a rigid thumb break strap in place.

A piece of Velcro® loop material 164' which has a configuration generally similar to the configuration of the central surface 432 is placed underneath the base of the loop device 400 and adjacent a side 110 of a holster 100 as shown in FIG. 4. The loop device 400 and underlying Velcro® material 164' is concurrently sewn to the side of the holster 110. The recesses/channels 410, 412 act as visual guides for the stitching 414, 416. Thus, the stitching 414, 416 secures both the loop device 400 and underlying Velcro® 164' to the holster side 110 in a one-step process.

Figure 5:
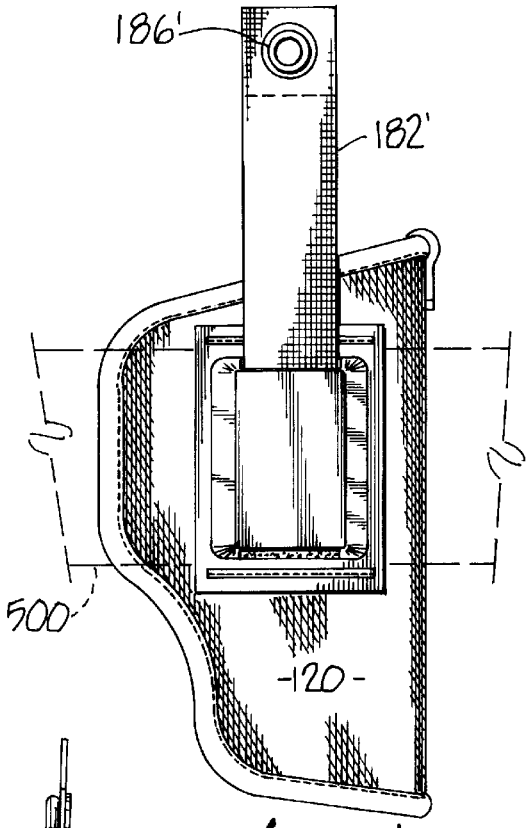
FIG. 5 shows an opposed elevation view of the holster of FIG. 5 with the FIG. 3 device in place and a flexible thumb break strap in place.
Figure 6:
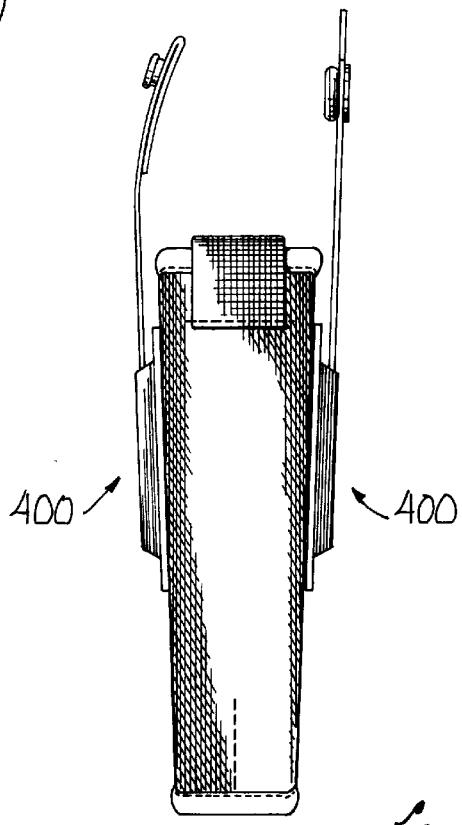
FIG. 6 is a front view of the holster of FIGS. 4 and 5 showing the belt loop devices on opposed sides of a holster.
Figure 7:
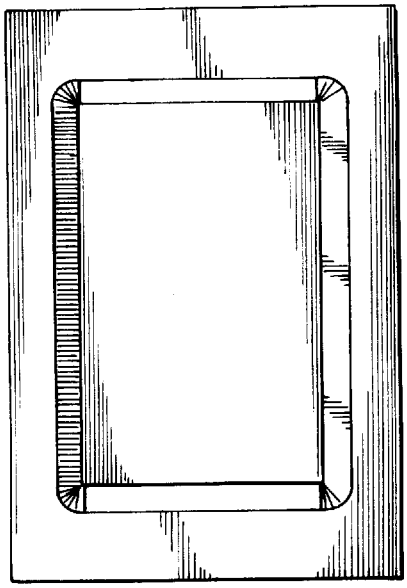
FIG. 7 is a rear view of the improved belt loop device of FIG. 3 thereto.

As the loop device 400 is secured side edges 408, 410 are free from the side 110 of the holster which presents a vertically extending loop for insertion of the user's belt 500 therethrough as shown in FIG. 5. (FIG. 5 shows a similar loop device 400 sewn to the opposed side 120 of the holster.) Moreover, the displacement of the central surface 432 from the underlying base 402 provides a second horizontally extending loop for extension of a respective thumb break strap 184' or 186' through the top aperture 442 and towards the lower aperture 440. Each strap 184', 186' has Velcro® material thereon designed to releasably engage the underlying Velcro® material 164' secured to the loop device 400.

Figure 8:
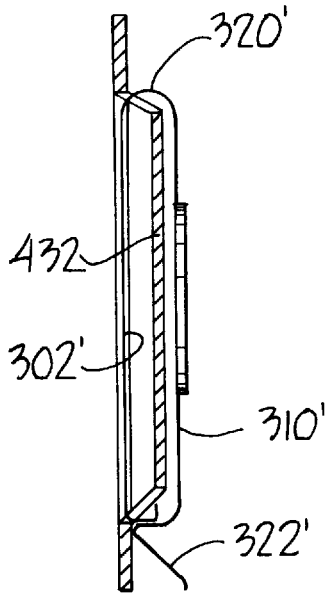
FIG. 8 is a side view of the belt loop of FIG. 7 with a spring belt clip in place.

Furthermore, the belt clip 300' as shown in FIG. 9 may be securely attached to the surface 432 of the loop device 400 as shown in FIG. 8. As such, the back flange 302' is inserted through the top aperture 442 of the central housing 430 and extends therethrough until the bottom U-shaped portion 304' engages the bottom edge 431 of the central surface 432. At this time the top edge 320' rests atop the top edge 433 of the central surface 430. The front flange 310' extends along the central surface. Accordingly, the front flange 310' may be displaced away from the central surface 432 by grasping the flange 310' at 320' and displacing the same. Upon such displacement the user's belt may be placed between the central surface 432 and the displaced flange portion 310'. Upon the desired placement the flange 310' is allowed to return to its original position. Thus, the belt clip 300 clips the holster to the user's belt 500 without the need for extension of the user's belt through the first vertical loop. The displacement of the central surface 432 from the underlying base 402 is such that the belt clip 300 will not interfere with extension of the thumb break straps 182' or 184' through the apertures 442, 440 and mating of the Velcro® material on the strap with Velcro® material 164'.

Accordingly, my unitary loop device 400' presents either a first vertically extending loop for extension of the user's belt therethrough or a second horizontally extending loop for purchase of a spring clip thereon and/or vertical extension of a thumb break strap 184' or 186' therethrough. Furthermore, the device 400 presents a relatively rigid surface for a more secure purchase of a spring belt clip 300 is presented such that the holster can be easily attached and maintained on the belt of the user. My device further reduces the labor required in affixing loops and Velcro® material to the opposed side of the holster relative to that shown in the prior art. It is understood that other advantages of the loop device 400 may arise which have not been set forth herein.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. For attachment of a holster made of a first flexible material to a belt of a user by either a belt clip or extending the belt through a loop on the holster, an attachment device for stitching to a side of the holster comprising:

a base made of a second material relatively more rigid than the flexible holster material, said base presenting top and bottom edges and side edges extending therebetween;

a pair of side walls in a predisposed extension away from said base;

a surface of material raised from said base and spanning said side walls, said raised surface presenting top and bottom edges displaced from said base;

a pair of apertures respectively presented between said top and bottom edges of said raised surface and said base, said apertures cooperating with said raised surface and said base to present a first channel between said raised surface and said base adapted for reception of a portion of the belt clip therethrough;

the stitching along said top and bottom edges of said base affixing said base to the holster with said side edges free from the holster to present a second channel between said base and the holster adapted for extension of the user's belt therethrough, whereby said device attaches the holster to the user's belt either with the belt clip or extension of the user's belt through said second channel.

2. The attachment device as claimed in claim 1 wherein the holster includes a releasable thumb break strap having a first fastener material thereon, the attachment device further comprising:

a web of fastener material interposed between the holster and said raised surface, said web of fastener material complementary with the fastener material on the thumb break strap, the thumb break strap having a lower end for extension at least through said top edge aperture and an upper end extending beyond said top edge of said raised surface, the complementary fastener material on the strap releasably engageable with said web of fastener material at selectable positions therealong, whereby to adjust the extension of the strap beyond said top edge of said raised surface.

3. The attachment device as claimed in claim 1 wherein said base includes an opening, said raised surface spanning said base opening.

4. The attachment device as claimed in claim 2 wherein said base includes an opening, said web of fastener material spanning said base opening.

5. The attachment device as claimed in claim 1 wherein said base, side walls and raised surface comprise the same material.

6. The attachment device as claimed in claim 1 wherein said base, side walls and raised surface comprise a one-piece, preformed construction.

7. For attachment to a side of a holster made of a flexible material, a preformed belt loop device comprising:

a base of material more rigid than the flexible holster material, said base presenting a first surface including top and bottom edge and side edges extending therebetween;

a second surface of a material more rigid than the flexible holster material raised from said base;

a pair of upper and lower walls extending between said base surface and said second surface, said walls made of a material for a predisposed extension of said walls;

an aperture in said upper and lower walls, whereby a stitching along said top and bottom edges affixes said base to the holster with said side edges free from the holster, said base surface cooperating with the holster to present a first loop adapted for extension of a user's belt therethrough, said raised second surface presenting a second loop defined by said apertures in said upper and lower walls, said second loop adapted for reception of a spring belt clip therein for clipping the holster to a user's belt.

8. The device as claimed in claim 7 further comprising first fastener material positioned underneath said raised second surface upon the stitching of said base to the holster, said second loop further adapted for reception of a thumb break strap having a lower end inserted through at least said aperture in said upper wall, the strap having a complementary second fastener material thereon for engagement with said first fastener material, whereby to adjust the point of contact of the strap along said first fastener material.

9. The device as claimed in claim 8 wherein one of said fastener materials comprises a plurality of loops thereon and the other fastener material comprises a plurality of complementary hooks thereon for engaging said loops.

10. The device as claimed in claim 7 further comprising means along said top and bottom edges of said base for guiding the stitching affixing said base to the holster.

11. The device as claimed in claim 10 wherein said guide means comprises a recess in said base extending along said top and bottom edges.

12. For attachment to a side of a holster, a belt loop device comprising:

a base, said base presenting top and bottom edges with at least one edge extending therebetween;

a central housing presenting a surface displaced from said base;

apertures on opposed sides of said housing;

a stitching along said top and bottom edges only of said base for affixing said base top and bottom edges only to the holster with said at least one side edge of said base free from the holster, said base cooperating with the holster to present a first loop for extension of a user's belt therethrough, said central housing presenting a second loop defined by said central surface and said apertures in said housing, said second loop adapted for reception of a spring belt clip therein for clipping the holster to a user's belt.

13. The device as claimed in claim 12 further comprising a first piece of fastener material positioned adjacent the holster and underneath said housing, said opposed apertures further adapted for reception of a thumb break strap therethrough, the strap having complementary fastener material thereon for engagement with said first piece of fastener material whereby to adjust said point of contact of the strap with the first fastener material.

14. For attachment to a side of a holster, a preformed belt loop device comprising:

a base;

a housing presenting a surface displaced from said base to present a space therebetween; and a pair of opposed apertures in said housing and in communication with said space;

a stitching along said base affixing said base to the holster, said housing surface presenting a loop defined by said opposed apertures, said surface adapted for reception of a spring belt clip thereon for clipping the holster to a user's belt;

a web of fastener material for interposition between the holster and said housing, said web of fastener material adapted to mate with complementary fastener material on a thumb break strap, the thumb break strap having a lower end for extension through said loop and an upper end extending exterior of said housing, the fastener material on the strap releasably engageable with said web of fastener material at selectable positions therealong, whereby to adjust the extension of the upper end of the strap exterior of said housing.

15. The device as claimed in claim 14 wherein the holster is made of a flexible material and said housing comprises a material more rigid than the material of the holster.

16. The device as claimed in claim 14 further comprising means on said base for presenting guidelines for the stitching.

17. The device as claimed in claim 16 wherein said presenting means comprises recesses in said base.

18. The device as claimed in claim 17 wherein said recesses are along a top and bottom of said base.

19. For attachment of a holster made of a first flexible material to a belt of a wearer by a belt clip having first and second legs biased into contact, the clip adapted for releasable clamping to a wearer's belt extending between the legs, a belt attachment device;

a base made of a rigid material relative to the holster material, said base including a pair of spaced-apart flanges protruding in a predisposed relationship away from said base, said base presenting a surface for fastening to at least a one side of the holster;

a clamping surface of said relatively rigid material having first and second opposed sides, said clamping surface spanning said protruding flanges in a predisposed displacement from said base to present a space therebetween;

a first aperture positioned in one of said pair of protruding flanges at a position between said clamping surface and said base to allow for an initial penetration of the first leg of the spring belt clip therethrough and extension through said space on said first side of said clamping surface with the second leg of the clip on said opposed second side of said surface whereby to initially displace the biased legs;

a second aperture spaced from said first aperture and positioned in the other of said protruding flanges at a position between said clamping surface and said base to allow for an extension of a free end of the first leg from said space and a return of the displaced legs of the belt clip into the biased contact with the clamping surface therebetween; and means for affixing said device to the holster to present said clamping surface for an extension of the wearer's belt across said second side of said surface and between the legs of the belt clip whereby to clamp the holster to the wearer's belt.

20. The attachment device as claimed in claim 19 wherein said second aperture is positioned between said clamping surface and said base in alignment with said first aperture.

21. The attachment device as claimed in claim 19 wherein said base, clamping surface and flanges comprise a preformed construction.

22. For attachment to a side of a holster, a preformed device for supporting a spring belt clip comprising:

a base;

a housing protruding from said base presenting a surface in a predisposed displacement from said base to present a permanent space therebetween;

a first aperture in said housing and in communication with said space for initial extension of a portion of a spring belt clip into said first aperture and said space for extension of the spring belt clip therefrom;

a second aperture in said housing displaced from said first aperture and in communication with said space for extension of the portion of the spring belt clip therethrough;

a web of fastener material spanning said base, said web of fastener material adapted to mate with a complementary fastener material on a thumb break strap inserted into said first aperture for extension into said space between said base and said housing surface, the fastener material on the strap releasably engageable with said web of fastener material at selectable positions therealong, whereby to adjust the extension of the strap beyond said housing;

means for affixing said base to the holster with said second aperture below said first aperture, said surface displaced from the holster in a generally vertical extension relative thereto to present a support surface for the spring belt clip, the extension of the portion of the spring belt clip through said apertures placing the clip at a position adapted for clamping a user's belt to said support surface.

23. The attachment as claimed in claim 22 wherein a portion of said affixed base is free from the holster for extension of a user's belt between the holster and said base, whereby to present a discrete loop for extension of the user's belt therethrough.

24. The attachment device as claimed in claim 22 wherein said base and housing comprise a one-piece construction.

25. The attachment device as claimed in claim 24 wherein said one-piece construction of said base and housing is of a material more rigid than a material of the holster.

* * * * *